US005992711A

United States Patent [19]

Mochizuki et al.

[11] Patent Number: 5,992,711

[45] Date of Patent: Nov. 30, 1999

[54] INTEGRATED SUBMERGED ENTRY NOZZLE AND ITS MANUFACTURE

[75] Inventors: Yoichiro Mochizuki; Tetsuro Fushimi; Etsuhiro Hasebe, all of Kariya; Moriki Hashio, Narashino; Toshihiko Murakami; Sei Hiraki, both of Kashima, all of Japan

[73] Assignees: Toshiba Ceramics Co., Ltd., Tokyo; Sumitomo Metal Industries, Ltd., Osaka, both of Japan

[21] Appl. No.: 09/064,009

[22] Filed: Apr. 22, 1998

[30] Foreign Application Priority Data

Apr. 22, 1997 [JP] Japan ..... 9-117489

[51] Int. Cl.[6] ..... B22D 41/08

[52] U.S. Cl. ..... 222/606; 266/236

[58] Field of Search ..... 222/590, 591, 222/600, 606, 607; 266/236, 280, 286; 501/133, 152, 154

[56] References Cited

U.S. PATENT DOCUMENTS

| | | | |
|---|---|---|---|
| 4,091,861 | 5/1978 | Thalmann et al. | 164/437 |
| 5,052,598 | 10/1991 | King et al. | 222/600 |
| 5,114,123 | 5/1992 | Pfyl | 266/236 |
| 5,173,199 | 12/1992 | Brueckner et al. | 222/600 |
| 5,174,908 | 12/1992 | King et al. | 222/600 |

FOREIGN PATENT DOCUMENTS

| | | |
|---|---|---|
| 50-36317 | 4/1975 | Japan . |
| 52-21303 | 5/1977 | Japan . |
| 52-21703 | 5/1977 | Japan . |
| 61-235062 | 10/1986 | Japan . |
| 4-182048 | 6/1992 | Japan . |
| 4-228258 | 8/1992 | Japan . |
| 4-300982 | 10/1992 | Japan . |
| 6-9749 | 2/1994 | Japan . |
| 6-335754 | 12/1994 | Japan . |
| 8-132191 | 5/1996 | Japan . |
| 8-229644 | 9/1996 | Japan . |
| 91/13713 | 9/1991 | WIPO . |
| 92/00822 | 1/1992 | WIPO . |
| 92/11105 | 7/1992 | WIPO . |

*Primary Examiner*—Scott Kastler
*Attorney, Agent, or Firm*—Foley & Lardner

[57] ABSTRACT

An integrated submerged entry nozzle for thin slab continuous casting has a plate member 12 corresponding to the lower plate of a slide gate and a nozzle member 11 having a flat molten steel passage section in the part to be submerged into molten steel of at least the tip, the both 11. 12 being integrated together by the use of an organic adhesive. The plate member 12 and the nozzle member 11 are separately formed followed by baking or firing, the both 11, 12 are adhered together by the use of an organic adhesive, the adhesive is dried, the outside is covered with a shell, and refractory mortar is filled in the space. Thereafter, a refractory ring 28 is adhered in such a manner as to cover the inside of the adhesive joint part followed by drying.

14 Claims, 4 Drawing Sheets

INTEGRATED SUBMERGED ENTRY NOZZLE AND ITS MANUFACTURE

BACKGROUND OF THE INVENTION

This invention relates to an integrated submerged entry nozzle (SEN) for continuous casting and in particular for thin slab continuous casting, and a method of manufacturing it.

DESCRIPTION OF RELATED ART

The hot rolling manufacturing process of a thin plate by a thin slab continuous casting equipment has lately been put into practical use, and spread on a worldwide scale predominantly with a mini-mill. The thickness of the thin slab is, for example, 50–120 mm.

This manufacturing process has an equipment layout having a continuous casting equipment directly connected to a strip mill, in which continuous operation in high-speed casting conditions is fundamental from the viewpoint of improvement in productivity and energy saving. In the field of continuous casting equipment, particularly, endless casting is strongly directed by the user's side, and a further development in the future is expected.

A SEN used in such a thin slab continuous casting equipment is an important part for ensuring stable operation and slab quality. However, the SEN for thin slab casting had a disadvantage in continuous operability, compared with a general continuous casting nozzle, because of the geometric limitation in connection with mold thickness.

In the continuous casting of a thin slab, when a nozzle is set in a mold, the space between the mold and the nozzle is narrow and it is no more than about several millimeters, with consideration of a coagulated shell within the mold. When a lengthy nozzle is held in only its upper end, a slight slippage in the upper end part extends to a slippage of several millimeters or more in the lower end part. Therefore, to precisely set the nozzle, a high dimensional precision is required to the nozzle itself.

On the other hand, in general continuous casting other than the thin slab continuous casting, replacement of a SEN is often performed without interrupting the supply of molten metal. In this case, the SEN is replaced by being slid while being pressed onto the plate of a tundish bottom part, and pushed into molten metal by a hydraulic cylinder or the like.

In this method, an integrated SEN formed of an upper part functioning as a plate and a lower part functioning as a SEN is used. The integrated SEN is formed by integrating a lower plate and a SEN, which are separately formed, together by bonding.

The bonding method therefore can be generally classified to a method of using bolts (for example, four bolts) and retainer rings and a method of covering the lower plate and the SEN with a shell followed by bonding with mortar.

In the first method (type 1), the lower plate and SEN of separate bodies are frequently integrated together by a user. In the second method (type 2), the castable lower plate and the SEN are on the market in the integrated state.

The SEN according to the first method had problems described below.

1) Misalignment between the lower plate and the SEN.

2) Generation of a joint gap between the lower plate and the SEN by deformation of a setting jig, or retainer ring and bolt, which results because the retainer ring and bolt are likely to be deformed by repeated use.

3) Requirement of a lot of time for setting on the user's side.

On the other hand, the integrated SEN according to the second method had the following problems caused by the lower plate being castable, the bonding strength between the lower plate and the SEN depending on only the bonding forces by the mortar and the shell, and the like:

1) Molten steel is apt to penetrate between the lower plate and the SEN because of a lack of bonding strength.

2) The castable lower plate is inferior in corrosion resistance and wear resistance to a general lower plate.

3) All-round welding is needed to bond a shell for covering the lower plate to a shell for covering the SEN, and this work is complicated.

In the thin slab continuous casting, the use of the integrated SEN made according to the prior art as described above was extremely difficult, because the dimensional limitation of the mold as described above requires a strict precision for the parallel degree or vertical degree to the mold long-edge wall of the SEN lower part. Although it was increasingly difficult to replace the SEN without interrupting the supply of molten metal in casting under these conditions, the improvement in productivity by continuation of operation is more essentially required in thin slab continuous casting than in the conventional general continuous casting.

Further, in high-speed casting conditions during the thin slab continuous casting operation, interrupting the supply of molten metal largely decreases the molten metal surface level in the mold. Thus, in view of continuation of operation and quality, the time of the interrupting must be extremely short or instantaneous.

The sliding surface of the plate part of the SEN for thin slab continuous casting is required to have sufficient smoothness, hardness and strength in order to provide a satisfactory adhesion with an upper stationary platen. Further, the nozzle part also must be highly resistant to spalling.

A SEN satisfying various requests in thin slab continuous casting does not yet exist.

SUMMARY OF THE INVENTION

An object of this invention is to provide an integrated submerged entry nozzle (SEN) having a flat tip portion so that the shape of a molten steel outflow port of the nozzle can be suitable for the molding shape so as to effectively improve the quality of a thin slab as well as normal steels made in continuous casting manners.

Another object of this invention is to provide an integrating method for producing SEN in which a plate member and a nozzle member can be separately produced and thereafter joined with each other by means of an organic adhesive so that the above-mentioned problems of the prior art can be solved, so as to have various characteristics such as high precision, high strength and excellent spalling resistance whereby nozzles can be smoothly replaced without interrupting casting operation in thin slab continuous casting.

By integrating both the members together in this way, entrainment of air or leakage of molten metal through the bonding surfaces of both the members can be prevented. Since the nozzle replacement can be performed while strongly pressing the plate member to an upper plate, entrainment of air in casting and in nozzle replacement can be also prevented. Further, insertion of ground metal can be also prevented in casting and in nozzle replacement so as to be resistant to long-time casting.

The plate member functions as a lower plate. Therefore, the plate member requires a high strength resistant to sliding and surface pressure. As the plate member, for example, a so-called alumina-carbon material is preferably used.

On the other hand, the nozzle member functions as a SEN. Therefore, the nozzle member requires a high spalling resistance. As the nozzle member, a so-called alumina-graphite material is preferably used. The plate member and the nozzle member are separately produced and then joined to each other. A reason for doing so will be explained. Starting materials for producing the plate member and the nozzle member are preferably different. It is preferable that a plate member made of alumina-carbon material or the like should be formed in a dense condition so as to increase its strength. Preferable methods for producing a member with increased strength are uniaxial compression forming methods such as hydraulic pressing. However, such uniaxial compression forming methods are not preferable for a nozzle member made of alumina-graphite or the like which includes graphite, because a formed body has directional or orientational problems so that it can not be homogeneous. Thus, a nozzle member is preferably made by cold isostatic press methods or the like.

Further, the plate member and the nozzle member are separately shaped and fired so as to improve forming precision of each member. Also, they can be easily formed at low cost.

For the above-stated reasons, the plate member and the nozzle member are separately shaped and fired and then joined to each other so as to make an integrated SEN according to this invention.

A tip portion of the nozzle member and at least a portion thereof which is submerged in the molten steel has a flat shape in vertical section to the axis of the nozzle member. Examples of the flat shape are an oblate shape, an ellipse or oval shape, a rectangular shape or any other generally elongate shape in cross section.

In case of such flat shapes, the shape of the tip portion of the nozzle member can be close to the mold shape. Thus, it is suitable in particular for the thin slab casting. The ratio of (Diameter/Breadth) or (Large Side/Short Side) is 1.5 or more, preferably, 2.0 or more from the viewpoint of the use for thin slab casting. The flat part may be extended to the whole length of the nozzle member, but in the vicinity of the part to be connected to the plate member, the nozzle hole preferably has a circular section, with consideration of the strength of the nozzle.

The area near of the bonding parts of the plate member and the nozzle member is preferably covered with a metal shell. The shell functions to prevent the oxidation of the organic adhesive. The shell further protects the integrated SEN by preventing damage of the integrated SEN by movement (sliding) within a continues casting equipment (tundish lower guide rail). The shell can be installed, for example, by the use of refractory mortar.

The shell can be arranged not only on the circumferential surface but also so as to vertically nip both the members to constrain them also in the vertical direction, whereby the slippage between the shell and the refractory can be surely prevented. The shell arranged on the upper part of the lower plate is situated slightly lower than the sliding surface of the lower plate so as to be slid on the upper plate.

On the inside (molten steel passage side) of the adhesive joint part between the plate member and the nozzle member, a refractory brick ring is preferably arranged in such a manner as to cover the joint part and perfectly block the clearance.

The refractory ring prevents the adhesive joint part from being exposed to a high-temperature oxidizing atmosphere in preheating and in use, so that the oxidation of the organic adhesive (layer) can be prevented. An organic adhesive using a resol type thermosetting phenol resin as described later, particularly, has a strong possibility of the adhesive strength extremely decreasing when the carbon in the resin is oxidized. The ring eliminates the possibility of penetration of molten metal to the adhesive surface.

The ring can be formed by the use of the same material as the nozzle member or the plate member, for example, $Al_2O_3$-C material.

The ring may be sufficiently fixed by mortar since no large load is added to the ring. At that time, highly oxidation resisting mortar is advantageously used.

The refractory ring prevents the adhesive joint part from being exposed to a high-temperature oxidizing atmosphere in preheating and in use, so that the oxidation of the adhered (layer) can be prevented.

As the organic adhesive (layer) for bonding the plate member to the nozzle, an adhesive formed of 10–30 wt. % of a resol type thermosetting phenol resin alcohol solution manufactured with a divalent metallic salt as a catalyst, 2–10 wt. % of at least one powder selected from metal aluminum powder, aluminum-magnesium alloy powder and aluminum-silicon alloy powder, and 60–88 wt. % of a refractory material is preferably used.

The application of this adhesive allows firm holding of the shape for a long time, and can provide a sufficient precision for stable operation including casting start by the regulation of the thickness of the adhesive itself.

Since the adhesive formed by adding the refractory material and metal powder to the resol type thermosetting phenol resin manufactured with a divalent metallic salt as a catalyst has a high bonding strength extending from low temperature area to high temperature area, and is more excellent in corrosion resistance than the SEN material with respect to swelling or corrosion even when it makes contact with molten metal, penetration of molten steel between both the members can be prevented.

The use of the resol type thermosetting phenol resin manufactured with divalent metallic salt as a catalyst can provide a high bonding strength, particularly, in a temperature range of 400–800° C. The resol type thermosetting phenol resin manufactured with a divalent metallic salt as a catalyst contains the chelate bonding with divalent metal by a hydroxyl group and a methylol group, which is changed to ether linkage by a thermal treatment of 120–130° C. The methylol group forming no ether linkage changes to methylene bonding from 70–80° C. and begins to harden. On the other hand, the ether linkage begins to harden from 130–150° C. because it changes to methylene bonding while generating for formalin.

The resol type thermosetting phenol resin manufacture with a divalent metallic salt as a catalyst has a hardening temperature range extending from low temperature to high temperature, and can keep a high bonding strength since the non-decomposed bond is mostly kept in the temperature range of 400–800° C.

The blending ratio of the resol type thermosetting phenol resin manufactured with divalent metallic salt as catalyst is limited to 10–30 wt. % for the following reason. When the blending ratio of the resin is less than 10 wt. %, sufficient bonding strength can not be provided, particularly, in the temperature range of 400–800° C. When the blending ratio of the resin exceeds 30 wt. %, the ratio of the refractory material is so minimized that a sufficient heat, resistance can not be provided.

From such a viewpoint, the more preferable blending ratio of the resol type thermosetting phenol resin is 15–25 wt. %.

At least one powder selected from metal aluminum powder, aluminum-magnesium alloy powder, and aluminum-silicon alloy powder is limited to 2–10 wt. % by the following reason. When the total amount of the powders is less than 2 wt. %, hot strength at 800° C. or more disadvantageously decreases. When the total amount exceeds 10 wt. %, the gas generated by the reaction with water or alcohol in the phenol resin solution increases to disadvantageously increase bubbles.

From the viewpoint described above, the blending ratio of the total amount of powder is more preferably set to 3–8 wt. %.

The maximum particle sizes of metal aluminum power, aluminum-magnesium alloy powder and aluminum-silicon alloy powder as well as the refractory material are preferably set to 0.5 mm or less. The reason is that the maximum particle size more than 0.5 mm introduces the fear of an insufficient strength of the adhesive. The dimensional regulation is also facilitated with 0.5 mm or less.

Examples of the refractory material include alumina, zirconia, a mixture of alumina and zirconia, and the like, and other materials are also applicable.

In the adhesion of the plate member to the nozzle member, the dimensional precision can be improved by fixing the both two by the use of a holding jig. Particularly, the vertical degree of the nozzle to the plate plane is important.

An integrated SEN according to this invention is made not only by adhering a plate member and a nozzle member by means of an organic adhesive, but also by joining them by mechanical means. The combination of such adhering and mechanical joining is effective for the purpose of avoiding such accidents that the nozzle member falls down when the adhesive directly contacts the molten steel by accident if a ring breaks away so as to stop continuous casting. Also, it can avoid peeling of the adhesive due to the differential thermal expansion between the plate member and the nozzle member in the vertical and peripheral directions in case of rapid heating for the preheating purpose prior to use of SEN.

Preferable means of mechanically joining the plate member and the nozzle member will be explained. For example. 2 to 4 small openings are formed on a peripheral portion of the nozzle member, and pins are inserted from a shell into the openings, respectively, and then the pins are fixed to the shell.

A method of manufacturing an integrated SEN according to this invention comprises separately molding a plate member and a nozzle member followed by baking or firing, adhering both together by an organic adhesive, drying the adhesive, and then adhering a refractory brick ring by mortar in such a manner as to cover the inside of the adhesive joint part followed by drying.

Since the characteristic required to the plate part is differed from the characteristic required to the nozzle part, and the shapes are also complicated, the molding pressure is hardly transferred uniformly in a single formation of both the parts, and the resulting unevenness introduces a possibility of insufficient strength. Even when the plate part is formed ahead, and the raw material of the nozzle part is then added followed by cold isostatic press, for example, in order to integrally form parts of different materials, a trouble such as cracking of the plate can not be avoided. Such a method also requires a significant post treatment in order to provide a precision as a thin slab SEN.

Therefore, in this invention, the plate part and the nozzle part are preliminarily separately manufactured, and thereafter integrated together by the use of an organic adhesive. The plate part and the nozzle part can be precisely manufactured with respective optimum materials, a fine control can be performed in the adhering process, and a lengthy product can be finally manufactured with hardly having an error from a design value. The extending of the bonding part for connection is not necessary, and this nozzle is most suitable for a SEN for thin slab casting used in a narrow space. When the circumference of the bonding parts of the plate member and the nozzle member is covered with a shell, it may be properly performed before or after the adhesion of the refractory brick ring.

BRIEF DESCRIPTION OF THE DRAWINGS

FIGS. 1A, 1B and 1C show an integrated SEN according to a preferred embodiment of this invention, wherein FIG. 1A and FIG. 1B are vertical sectional views, and FIG. 1C is a horizontal sectional view.

DETAILED DESCRIPTION OF PREFERRED EMBODIMENTS

Preferred embodiments of this invention are further illustrated in reference to the drawings.

Figure 1A:
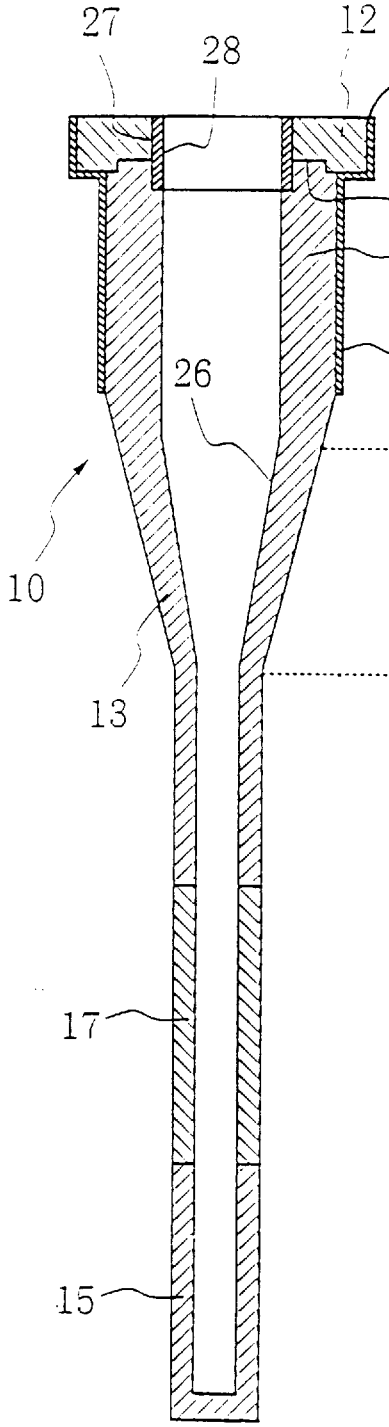
Figure 1B:
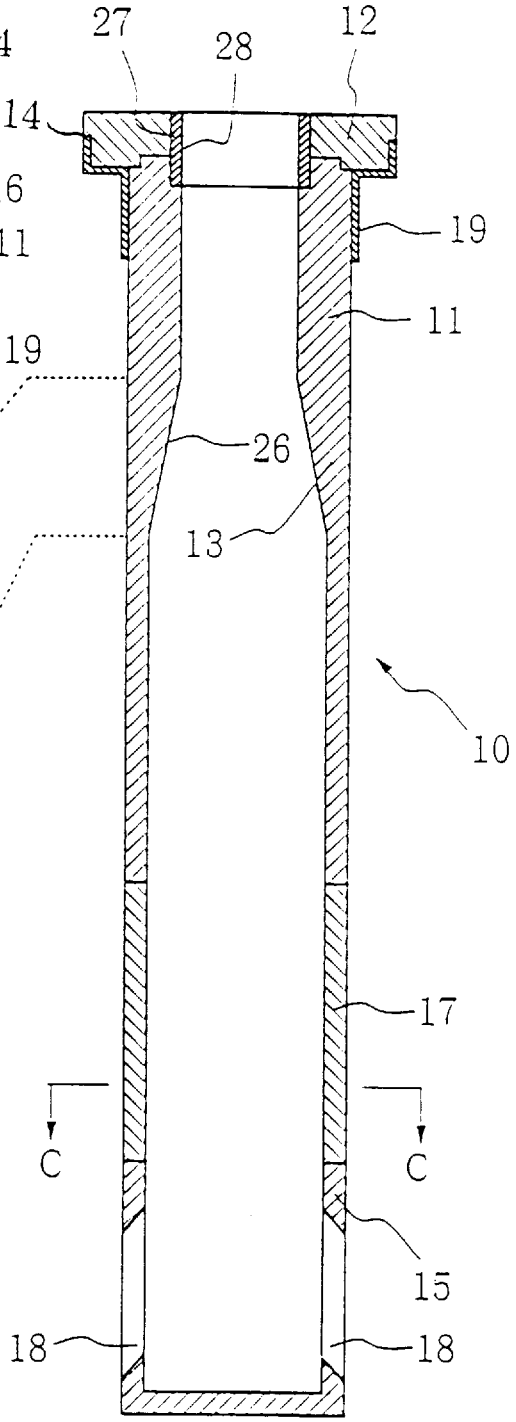
Figure 1C:
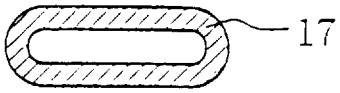

FIGS. 1A–1C are sectional views of an integrated SEN according to a preferred embodiment of this invention, wherein FIG. 1A and FIG. 1B are vertical sectional views, and FIG. 1C is a horizontal sectional view taken along line C—C in FIG. 1B.

An integrated dipping nozzle 10 is formed of a plate member 12 and a nozzle member 11 which are adhered together by an organic adhesive. Namely, an adhesive layer 16 is formed in the bonding are between both of the members. As the organic adhesive, for example, adhesives described in following Examples 1–11 described later can be used.

The plate member 12 is formed of alumina-carbon material or zirconia-carbon material having high strength and high sliding characteristics, and functions as a lower plate.

On the other hand, the nozzle member 11 is formed of alumina-graphite material or zirconia-graphite material having a high spalling resistance, and functions as a SEN.

The nozzle member 11 is formed of a nozzle body 13, an intermediate part 17, and a nozzle tip part 15 which are mutually connected. The upper section of the molten steel outflow port of the nozzle body 13 is circular, but it is transferred to a non-circular slender form in a transfer part 26 in the middle. The molten steel outflow port is slender in the middle part 17 and the tip part 15.

The section of the tip of the molten steel outflow port has a crushed form applicable to thin slab casting such as a flat, elliptic or rectangular form.

The tip part 15 has a molten steel outflow opening 18.

A refractory brick ring 28 is fixed to the inner circumference near the bonding area of a plate member 12 and a nozzle member 11 by mortar. The material of the refractory brick is formed of, for example, alumina-carbon material, alumina graphite material or the like, and other materials may be used when the refractory brick has a strength of 5 MPa or more.

A shell 19 is mounted on the outside of the plate member 12 and the nozzle 11 through mortar 14. The shell 19 is formed of, for example, SPHC steel (Japanese Industrial Standard), and the thickness of the shell can be set to, for example, 3.2 mm. As the material, thickness and shape of the shell 19, various ones conventionally employed can be adapted.

Figure 2:
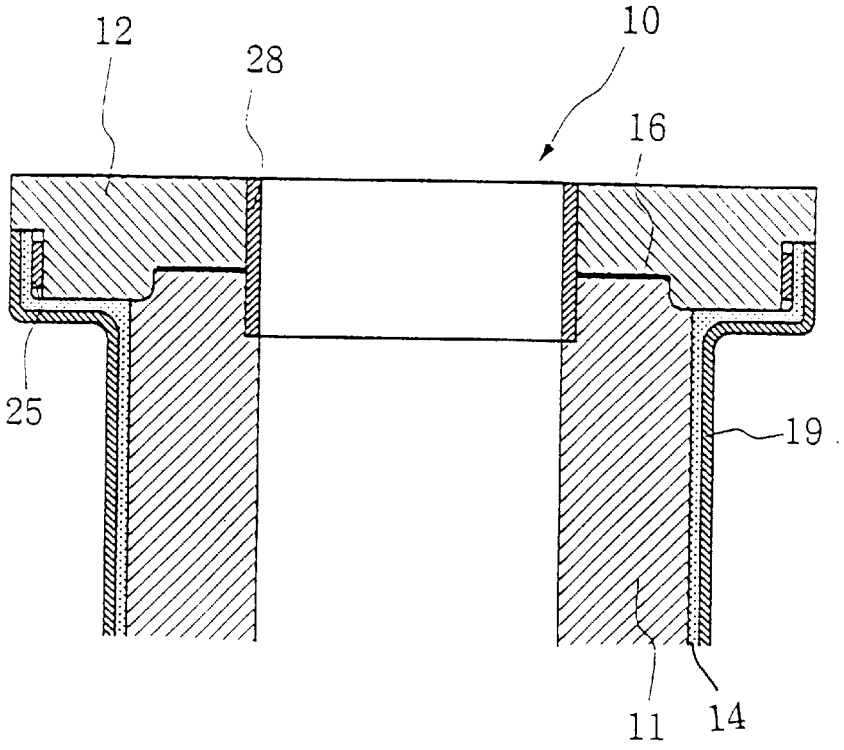
FIG. 2 is a sectional view of a further preferred embodiment of this invention used in an actual machine test.
Figure 3:
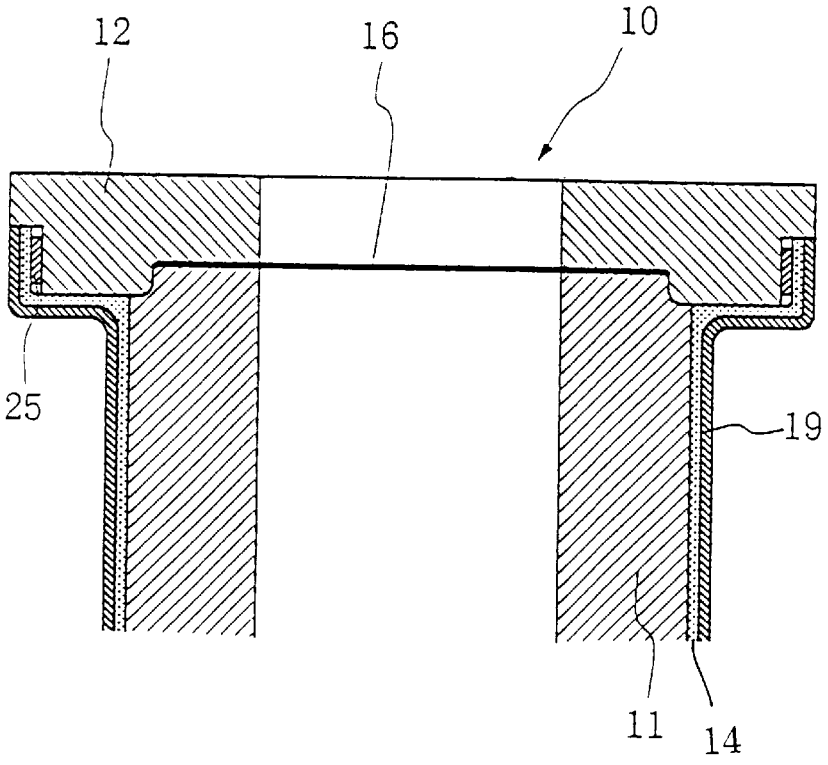
FIG. 3 is a sectional view of another preferred embodiment of this invention used for actual machine test.

FIGS. 2 and 3 show other embodiments of the integrated SEN. The embodiment of FIG. 3 has no refractory brick ring.

An iron hoop 25 is arranged between the upper part of the shell 19 and the plate member 12.

One example of setting of the plate member and the nozzle member is shown below.

1) Working

The plate member and the nozzle member are separately molded followed by baking or firing, and a necessary machining is performed.

An iron hoop is shrinkage-fitted to the plate member.

2) Adhesion

A dowel of the nozzle member is adhered to the dent of the plate member by the applying of the adhesive.

In the above-stated adhesion step, the plate member and the nozzle member are adhered together while holding the both in a prescribed positional relation by the use of a fixing jig.

3) Drying

Dried at 200° C. or below for 24 hr or more.

4) Setting

Mortar is applied, and the ring and shell are set.

The upper surface part shell is welded if necessary.

5) Drying

Dried at 50–70° C. for 12 hr or more.

6) Application of a coating agent

A thin slab continuous casting test was performed by the use of integrated SEN of the embodiments of this invention shown in FIGS. 2 and 3 and of type 2 described as the prior art.

As a result, no trouble was particularly observed in the integrated nozzle of FIG. 2 with a good quality of steel. In the integrated nozzle of FIG. 3, a clearance is slightly formed, and a slight leakage of steel into it by penetration of molten steel considered to be caused by the oxidation of the adhesive was observed.

In contrast to these, in the integrated SEN for thin slab casting formed according to the conventional method of type 2, the steel leakage by penetration of molten steel between the lower plate and the SEN, and the production of pin holes considered to be caused by air suction from the sliding surfaces were observed.

Figure 5:
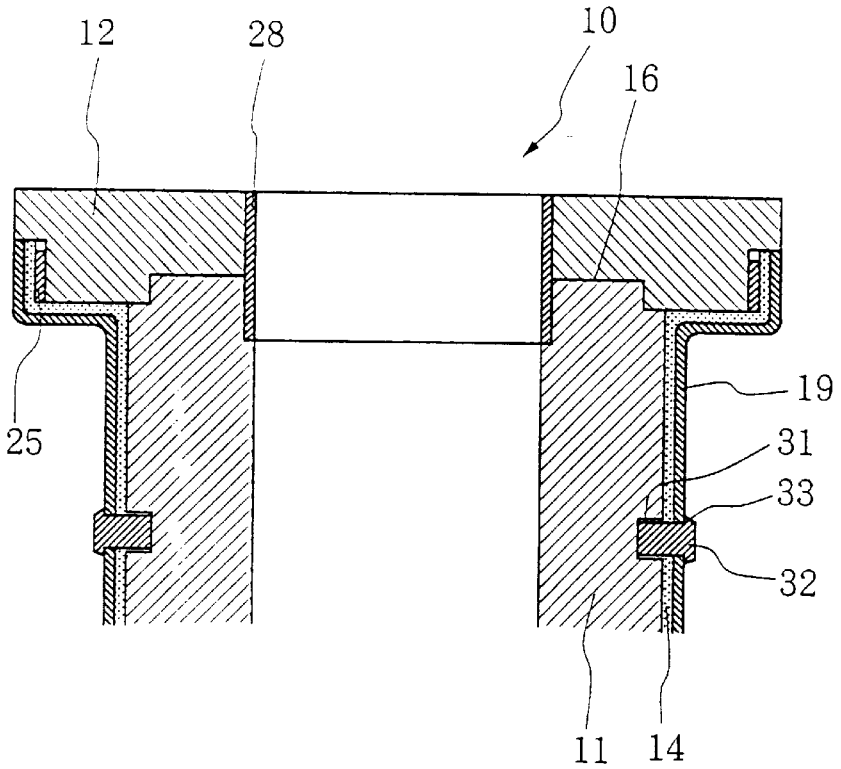
FIG. 5 is a sectional view of a further preferred embodiment of this invention.
Figure 6:
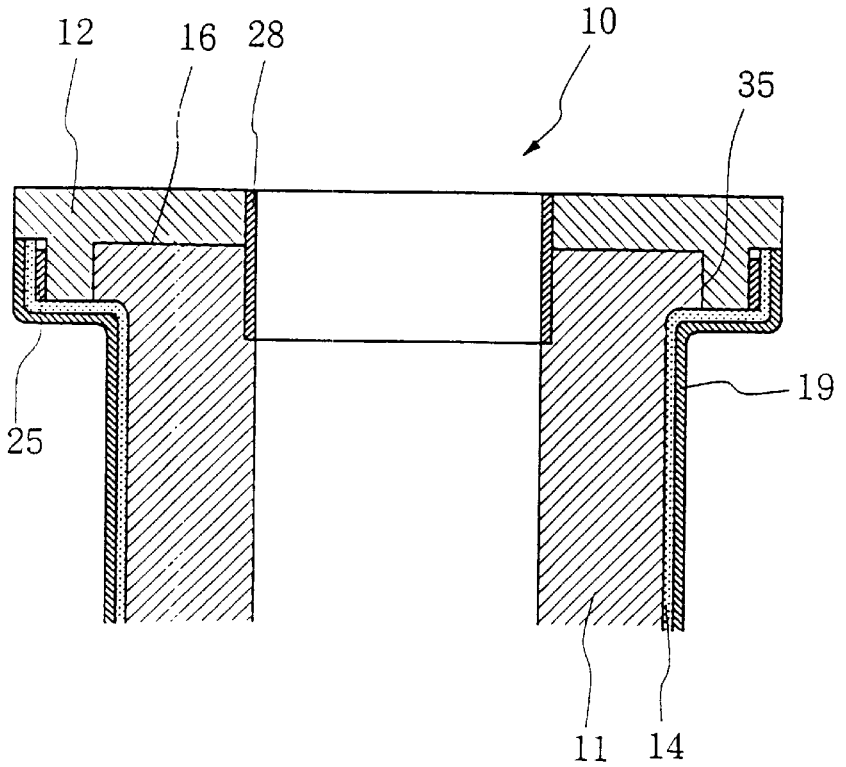
FIG. 6 is a sectional view of a further embodiment of this invention.

FIGS. 5 and 6 show additional embodiments of this invention. The embodiment of FIG. 5 is similar to the embodiment of FIG. 2 except the fact that 4 small holes 31 are fomed on the periphery of the nozzle member 11, and the shell 19 has 4 small holes 31 corresponding in position and size to those of the nozzle member 11. The plate member 12 and the nozzle member 11 are adhered to each other by means of an organic adhesive, and then the shell 19 is attached thereto. After that, pins 32 made of a metal which is the same as one of the shell are inserted into the small holes 31 of the nozzle member where some mortar 14 remains. Finally, the pins 32 are fixed to the shell 19 by welding means.

The embodiment of FIG. 6 is similar to the embodiment of FIG. 5 except the mechanical joining or bonding means. In FIG. 5, no pins are used as the mechanical joining means, and a large-diameter portion 35 is formed at the upper end portion of the nozzle member 11 itself. The diameter of the large-diameter portion 35 is enlarged so as to be larger than the diameter of the nozzle body portion in the shell 19 whereby they can be mechanically joined.

In case the above-stated mechanical joining is combined with the adhesive joining, so called falling down problems can be avoided even if the adhesive accidentally contacts the molten steel.

[EXAMPLES 1–11]

Figure 4:
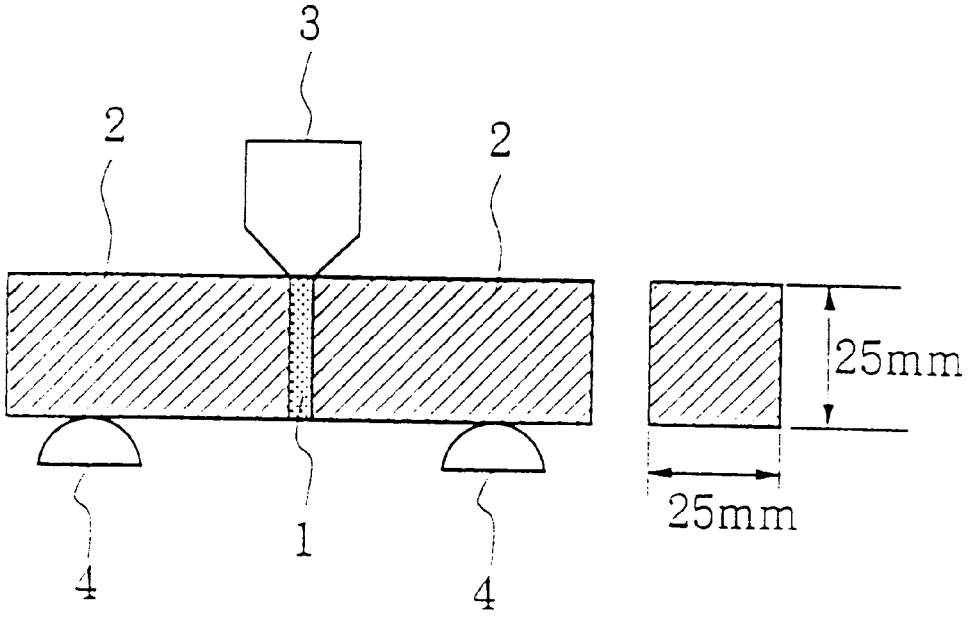
FIG. 4 is an illustrating view showing the method of adhesive test for an adhesive used in this invention.

In order to evaluate the bonding force of the organic adhesives used in this invention, adhesives of Examples 1–11 shown in Table 1 were prepared. Adhesive tests of samples cut from alumina-carbon for plate member material, alumina-graphite for nozzle member material, zirconia-carbon for plate member material, and zirconia-graphite refractory for nozzle member material were performed. The testing method is shown in FIG. 4.

A sample 2 is a square material having a 25×25 mm section, and each adhesive of Table 1 was applied to the 25×25 mm surface to bond two samples followed by hardening at 200° C. The thickness of an adhesive layer 1 was set to 0.5 mm or less. Thereafter, a force was added to the samples supported with a span of 75 mm at a cross head speed of 1 mm/min to evaluate the bonding force of the adhesive.

The test result is shown in Table 1.

For comparison, the same adhesion test was performed by the use of adhesives of Comparative Examples 1–11 as shown in Table 2. In Comparative Examples 10 and 11, the same test was performed by the use of mortar.

Consequently, it was confirmed that satisfactory adhesive characteristics can be provided in Examples 1–11 of this invention, compared with Comparative Examples 1–11.

In the column of the material used for measurement of adhesive strength in the tables, AC-AG shows adhesion of alumina-carbon material to alumina graphite material, and ZC-ZG shows the adhesion of zirconia-carbon material to zirconia-graphite material.

[EXAMPLE 12]

By the use of plate and nozzle materials having characteristics shown in Table 3, a SEN for thin slab casting shown in FIG. 1 was manufactured. The nozzle tip part is formed of the same material as the nozzle body part.

The organic adhesive of Example 3 shown in Table 1 was used.

The adhered joint thickness was set to 0.5 mm or less, and drying was performed at 150° C. for 3 hr as a jig for vertically fixing the plate and the nozzle remains set, and after that it was confirmed that the vertical slippage after adhesive hardening was within a slippage of 0.1–0.2% at maximum of the nozzle length to the vertical axial line.

Since the joint can be thinly regulated, compared with mortar the vertical dimensional precision could be controlled with extreme satisfaction.

The integrated SEN of this invention has particularly high precision, high strength and also high spalling resistance, and is suitable as a thin slab nozzle. The use of the integrated SEN of this invention allows the smooth replacement of nozzle without interrupting the casting of thin slab. Since it has no trouble such as air entrainment or ground metal insertion at that time, the quality reduction in a steel piece joint part is minimized, a satisfactory casting piece can be provided, and a stable operation can be also ensured and kept.

This invention is not limited by the embodiments described above. For example, the shape, drying temperature and time, and the like of the plate member may be properly changed to optimum ones.

Also, this invention is not limited to the embodiments in the form of thin slab continuous casting. All embodiments are within the sclope of this invention, in which an integrated dipping nozzle is designed for the casting purpose, if the nozzle has a flat tip portion. The nozzle can be used for casting any other elements.

TABLE 1

| | | Ex. 1 | Ex. 2 | Ex. 3 | Ex. 4 | Ex. 5 | Ex. 6 | Ex. 7 | Ex. 8 | Ex. 9 | Ex. 10 | Ex. 11 |
|---|---|---|---|---|---|---|---|---|---|---|---|---|
| refractory | 1.0–0.5 mm | | | | | | | | | | | |
| material | −0.5 mm | | | | | | 29 | | | | | |
| (alumina) | −0.45 μm | 76 | 79 | 76 | 76 | 76 | 47 | 80 | 72 | 84 | 64 | 74 |
| Metal powder Al | −0.2 mm | 6 | | | | | | | | | | |
| Al—Mg | −1.0 mm | | | | | | | | | | | |
| | −0.5 mm | | | | | 6 | | | | | | |
| | −0.2 mm | | 3 | 6 | | | 6 | 2 | 10 | 6 | 6 | 6 |
| Al—Si | −0.1 mm | | | | 6 | | | | | | | |
| Resol type thermosetting phenol resin alcohol solution manufactured with divalent metallic salt as catalyst | | 18 | 18 | 18 | 18 | 18 | 18 | 18 | 18 | 10 | 30 | 20 |
| Resol type thermosetting phenol resin alcohol solution | | | | | | | | | | | | |
| Adhesive material *1 | | AC—AG | AC—AG | AC—AG | AC—AG | AC—AG | AC—AG | AC—AG | AC—AG | AC—AG | AC—AG | ZC-ZG |
| Working property | | ◎ | ◎ | ◎ | ◎ | ○ | ○ | ◎ | ◎ | ○ | ○ | ◎ |
| Bending strength | R.T. | 10.1 | 11.8 | 12.0 | 11.0 | 10.7 | 10.7 | 11.9 | 10.7 | 6.0 | 13.0 | 8.6 |
| Mpa | 400° C. | 8.4 | 9.2 | 10.3 | 9.6 | 9.3 | 9.3 | 8.1 | 9.8 | 8.1 | 9.2 | 6.5 |
| | 800° C. | 7.7 | 9.5 | 10.5 | 7.4 | 7.4 | 7.4 | 8.0 | 9.8 | 6.2 | 7.0 | 7.3 |
| | 1400° C. | 8.6 | 9.0 | 11.2 | 8.6 | 10.2 | 10.2 | 6.5 | 6.8 | 6.5 | 6.5 | 9.7 |

*1 Material used for measurement of adhesive strength; AC—AG: Adhesion of alumina-carbon to alumina-graphite ZC–ZG: adhesion of zirconia-carbon to zirconia-graphite

TABLE 2

| | | Comp. Ex. 1 | Comp. Ex. 2 | Comp. Ex. 3 | Comp. Ex. 4 | Comp. Ex. 5 | Comp. Ex. 6 | Comp. Ex. 7 | Comp. Ex. 8 | Comp. Ex. 9 | Comp. Ex. 10 | Comp. Ex. 11 |
|---|---|---|---|---|---|---|---|---|---|---|---|---|
| refractory | 1.0–0.5 mm | | | | | 15 | | | | | | |
| material | −0.5 mm | | | | | 21 | | | | | | |
| (alumina) | −0.45 μm | 82 | 82 | 79 | 76 | 40 | 81 | 71 | 85 | 63 | | |
| Metal powder Al | −0.2 mm | | | | | | | | | | | |
| Al—Mg | −1.0 mm | | | | 6 | | | | | | | |
| | −0.5 mm | | | | | | | | | | | |
| | −0.2 mm | | | | | 6 | 1 | 11 | 6 | 6 | | |
| Al—Si | −0.1 mm | | | | | | | | | | | |
| Resol type thermosetting phenol resin alcohol solution manufactured with divalent metallic salt as catalyst | | | 18 | | 18 | 18 | 18 | 18 | 9 | 31 | | |
| Ether linkage hardening phenol resin powder | | | | 3 | | | | | | | | |
| Resol type thermosetting phenol resin alcohol solution | | 18 | | 18 | | | | | | | | |
| Mortar | | | | | | | | | | | 100 | 100 |
| Adhesive material *1 | | AC—AG | AC—AG | AC—AG | AC—AG | AC—AG | AC—AG | AC—AG | AC—AG | AC—AG | AC—AG | ZC—ZG |
| Working property | | ◎ | ◎ | ◎ | ◎ | ○ | ◎ | ◎ | Δ | ○ | — | — |
| Bending strength | R.T. | 11.9 | 12.0 | 9.3 | *2 | | 12.0 | 10.7 | 5.0 | 13.0 | 11.8 | 11.5 |
| Mpa | 400° C. | 7.1 | 8.1 | 8.1 | 3.8 | *2 | 7.2 | 9.3 | 7.2 | 9.2 | 8.9 | 8.0 |
| | 800° C. | 6.3 | 7.1 | 5.2 | *2 | | 7.0 | 9.8 | 7.0 | 6.0 | 5.4 | 4.0 |
| | 1400° C. | 4.5 | 4.7 | 5.7 | 4.1 | | 4.9 | 5.0 | 6.7 | 5.4 | 4.2 | 3.5 |

*1 Material used for measurement of adhesive strength; AC—AG: Adhesion of alumina-carbon to alumina-graphite ZC—ZG: Adhesion of zirconia-carbon to zirconia-graphite
*2 Peeled before measurement

TABLE 3

| | | Plate | Nozzle Material | |
|---|---|---|---|---|
| | | Material | Body part | Powder line part |
| Chemical Component (wt. %) | $Al_2O_3$ | 78 | 38 | — |
| | C + SiC | 8 | 32 | 15 |
| | $SiO_2$ | 0.5 | 23 | — |
| | $ZrO_2$ | 10 | 5 | 78 |
| Apparent Porosity (%) | | 6.0 | 16.0 | 17.0 |
| Bulk Specific Gravity | | 3.25 | 2.30 | 3.80 |
| Bending Strength (Mpa) | | 30 | 7.8 | 7.5 |
| Coeffcient of Thermal Expansion (%) at 1000° C. | | 0.70 | 0.35 | 0.50 |

*1. C in the plate material shows carbon.
*2. C in the nozzle material shows graphite.

We claim:

1. An integrated submerged entry nozzle for continuous casting equipment, which includes a slide gate having at least a lower plate and an upper plate, comprising:

a plate member;

a nozzle member bonded to said plate member; and a refractory ring fixed to the plate member and the nozzle member;

wherein the nozzle member has a molten steel passage with a flat passage section at a lower portion of the nozzle member and is adapted for insertion into molten steel;

wherein the plate member and the nozzle member are bonded by an organic adhesive; and wherein the refractory ring covers a bonded inner area between the plate and nozzle members.

2. An integrated submerged entry nozzle according to claim 1, wherein the organic adhesive includes 10–30% by weight of a resol thermosetting phenol resin alcohol solution manufactured with a divalent metallic salt as a catalyst, 2–10% by weight of at least one powder selected from the group consisting of metal aluminum powder, aluminum-magnesium alloy powder and aluminum-silicon alloy powder, and 60–88% by weight of a refractory material.

3. An integrated submerged entry nozzle according to claim 2, wherein a maximum particle size of the refractory material, the metal aluminum powder, the aluminum-magnesium alloy powder and the aluminum-silicon alloy powder is no greater than 0.5 mm.

4. An integrated submerged entry nozzle according to claim 1, further comprising a shell fixed to the plate member and the nozzle member, wherein the shell covers a bonded outer area of the plate member and the nozzle member.

5. An integrated submerged entry nozzle according to claim 1, wherein the plate member and the nozzle member are mechanically joined.

6. An integrated submerged entry nozzle according to claim 5, further comprising a plurality of pins joining the plate member and the nozzle member at a plurality of points along a peripheral portion of the nozzle member.

7. An integrated submerged entry nozzle for continuous casting, comprising:

a plate member;

a nozzle member adhesively bonded to the plate member with an organic adhesive, wherein the nozzle member has a molten steel passage which has a flat passage section at a lower portion for submerging into molten steel; and a refractory ring arranged adjacent to the plate member and the nozzle member so as to cover a bonded portion between the plate member and the nozzle member.

8. An integrated submerged entry nozzle according to claim 7, wherein the organic adhesive includes 10–30% by weight of a resol thermosetting phenol resin alcohol solution manufactured with a divalent metallic salt as a catalyst, 2–10% by weight of at least one powder selected from the group consisting of metal aluminum powder, aluminum-magnesium alloy powder and aluminum-silicon alloy powder, and 60–88% by weight of a refractory material.

9. An integrated submerged entry nozzle according to claim 8, wherein a maximum particle size of the refractory material, the metal aluminum powder, the aluminum-magnesium alloy powder and the aluminum-silicon alloy powder is no greater than 0.5 mm.

10. An integrated submerged entry nozzle according to claim 7, further comprising a shell fixed to the plate member and the nozzle member, wherein the shell covers a bonded outer area of the plate member and the nozzle member.

11. An integrated submerged entry nozzle according to claim 7, wherein the plate member and the nozzle member are mechanically joined to each other.

12. An integrated submerged entry nozzle according to claim 11, further comprising a plurality of pins for joining the plate member and the nozzle member at a plurality of points along a peripheral portion of the nozzle member.

13. A method of manufacturing an integrated submerged entry nozzle for thin slab continuous casting which comprises the steps of:

molding separately a plate member and a nozzle member, wherein the nozzle member has a flat molten steel passage section at one end;

baking the plate member and the nozzle member;

bonding the plate member and the nozzle member together with an organic adhesive;

drying the organic adhesive; and fixing a refractory ring to the plate member and the nozzle member so that the refractory ring covers a bonded portion between the plate member and the nozzle member.

14. A method of manufacturing an integrated submerged entry nozzle according to claim 13, wherein the organic adhesive includes 10–30% by weight of a resol thermosetting phenol resin alcohol solution manufactured with a divalent metallic salt as a catalyst, 2–10% by weight of at least one powder selected from the group consisting of metal aluminum powder, aluminum-magnesium alloy powder and aluminum-silicon alloy powder, and 60–88% by weight of a refractory material.

* * * * *